US005839024A

United States Patent [19]

May et al.

[11] Patent Number: 5,839,024

[45] Date of Patent: *Nov. 17, 1998

[54] CORONA CHARGING OF A CHARGE RETENTIVE SURFACE

[75] Inventors: John W. May, Rochester; Martin J. Pernesky, Hornell; Bruce R. Benwood, Churchville, all of N.Y.

[73] Assignee: Eastman Kodak Company, Rochester, N.Y.

[ * ] Notice: The term of this patent shall not extend beyond the expiration date of Pat. No. 5,642,254.

[21] Appl. No.: 858,752

[22] Filed: May 19, 1997

[51] Int. Cl.[6] ..... G03G 15/02

[52] U.S. Cl. ..... 399/89; 250/324; 361/235; 399/171

[58] Field of Search ..... 399/89, 50, 168, 399/170, 171; 361/225, 229, 230, 235; 250/324, 325, 326; 363/26

[56] References Cited

U.S. PATENT DOCUMENTS

| | | | |
|---|---|---|---|
| 3,699,335 | 10/1972 | Giaimo, Jr. | 250/326 |
| 4,038,593 | 7/1977 | Quinn | 363/97 |
| 4,166,690 | 9/1979 | Bacon et al. | 399/89 |
| 4,417,804 | 11/1983 | Werner, Jr. | 399/50 |
| 4,731,633 | 3/1988 | Foley et al. | 399/168 |
| 4,775,915 | 10/1988 | Walgrove, III | 361/225 |
| 4,910,400 | 3/1990 | Walgrove | 250/324 |
| 5,539,501 | 7/1996 | Yu et al. | 399/171 |
| 5,642,254 | 6/1997 | Benwood et al. | 361/235 |

*Primary Examiner*—Arthur T. Grimley
*Assistant Examiner*—Sophia S. Chen
*Attorney, Agent, or Firm*—Norman Rushefsky

[57] ABSTRACT

A corona charger for depositing an electrostatic charge on a charge retentive surface, without the creation of sheeting defects, the charger includes a coronode, and a power supply operating in cycles and providing in each of the cycles electrical power to the coronode to produce a net positive charging current with voltage to the coronode from the power supply operating in a portion of each cycle with a positive polarity to generate positive corona emissions. The power supply operates so that an AC component of the voltage provided by the power supply has a positive polarity in the range of about 60% to about 85% of each cycle. When operating in a broader range of greater than 50% but less than 100%, DC equivalent current to the coronode is controlled below a value causing sheeting.

24 Claims, 11 Drawing Sheets

CORONA CHARGING OF A CHARGE RETENTIVE SURFACE

CROSS REFERENCE TO RELATED APPLICATION

This application is related to U.S. application Ser. No. 08/858,319, filed on even date herewith in the names of Tombs et al and entitled "Instability Detection For Corona Chargers."

BACKGROUND OF THE INVENTION

1. Field of the Invention

The present invention is directed to corona chargers and to a method for corona charging a charge retentive surface in an electrostatographic recording apparatus.

2. Description Relative to the Prior Art

For positive charging of a photoconductor to a uniform voltage level using a corona wire charger in a copier, it is usual to employ a DC corona charger rather than an AC corona charger. There are two good reasons for this, namely, lower impedance and higher uniformity of charging. On the other hand, DC positive charging can give rise to a copy quality defect known as "sheeting" or "pepper tracking" (hereinafter referred to as sheeting), especially at low relative humidity (RH). Sheeting can be serious for tungsten corona wires, especially aged wires that have been used for a long time in a copier. Sheeting is also found to a lesser but still objectionable degree using platinum alloy wires. Small, localized areas on the corona wires, or "hot spots", can emit bursts of positive ions in self-limiting streamers or pulses which are of the order of microseconds in duration. Streamers may be observed in the dark as visible localized glows. Repetitive pulses, at intervals typically in the range 2 to 20 milliseconds from a given "hot spot", can produce chains of small areas of excess positive charge on a moving photoconductor in a copier. These pulse trains are somewhat irregular in time and start and stop rather randomly. Groups of "hot spots" can produce bands of highly charged circular spots on a moving photoconductor. The local charge density in these spots far exceeds the surrounding average charge density on a photoconductor as it leaves a charging station in a copying machine. When the charged photoconductor is exposed to light, the highly charged micro-areas caused by sheeting on the surface of the photoconductor are barely discharged compared to locally surrounding areas. After toning by the technique of discharged area development, and the toner transferred to paper, sheeting defects in the resulting copy appear as small circular white spots, each having a surrounding dark ring of excess toner. These spots typically have diameters in the approximate range 0.1 to 1 mm. If the technique of charged area development is used instead to develop the charge pattern, dark circular spots, each having a light surrounding ring, are produced in the resulting copy. Sheeting defects are objectionable, especially for high quality electrophotographic applications, and there is a need to prevent or limit their occurrence.

As is well known, AC charging typically uses a corona wire charger in which a high voltage AC signal is applied to the corona wires to produce corona emission. This signal usually has an AC voltage component superimposed on a DC offset voltage. The time durations of the positive and negative excursions of the AC component of the waveform are equal, a condition defined here as 50% duty cycle. Prior art using wire chargers (see below) has disclosed AC charging using higher duty cycles. For negative charging using a hypothetical square wave, a negative duty cycle of 80% would require an AC signal in which the negative polarity excursion is four times longer than the positive polarity excursion. For positive charging, a positive duty cycle of 80% would give an AC signal in which the positive polarity excursion is four times longer than the negative polarity excursion. A duty cycle of 100% for either polarity is equivalent to DC charging.

Prior art has disclosed the use of pulse width modulated waveforms in AC charging. In U.S. Pat. Nos. 4,775,915 and 4,910,400 both filed in the name of Walgrove, a non-gridded AC charger includes a conductive electrode and a corona wire between the electrode and the receiver. A variable duty cycle, pulsing voltage is applied to the electrode of the same sign as the (DC) voltage applied to the corona wire, such that the corona charge produced by the wire is periodically accelerated by the electrode to the receiver. U.S. Pat. No. 4,166,690 filed in the name of Bacon et al describes a digitally regulated power supply, in which a digital regulator in conjunction with at least one pulse width modulated power supply permits very fast rise times of the power supply current. Benwood, May and Pernesky in U.S. application Ser. No. 08/613,647 filed Mar. 11, 1996, now U.S. Pat. No. 5,642,254, have disclosed the use of high duty cycle AC corona charging using a gridded corona wire charger, in which the potential of the corona wire is above the corona threshold for both polarities of the AC signal. May and Pemesky in U.S. application Ser. No. 08/706,097 filed Aug. 30, 1996 have disclosed the use of high duty cycle negative AC charging using a gridded charger having sawtooth arrays for corona generation. Sullivan and Marcelletti in U.S. application Ser. No. 08/671,461 filed Jun. 27, 1996 describe the use of two pulsed DC chargers operating in tandem to produce alternate portions of the AC cycle (which includes a programmable dead time), whereby the pulse width of each polarity can be separately controlled for application to high duty cycle charging.

U.S. Pat. No. 4,731,633 to Foley et al describes an ungridded corona wire DC charger (corotron) for positive charging in which at least one negative polarity voltage pulse is applied periodically for the prevention of sheeting ("pepper tracking"). Apparently, this negative pulse "heals" incipient "hot spots", which require a certain time to develop when the corona wire is at high positive potential. This negative polarity voltage pulse (or pulses) interrupts the essentially DC operation of the charger "in a manner having minimal effect on charging functions". It is disclosed by Foley et al that an ungridded charger may be a operated in square-wave AC mode at 300 Hz during "cycle up", "standby", and "cycle out" periods, and operated during actual positive charging in a half-wave rectified square wave or pulsed DC mode (in which negative excursions of voltage are absent). A non-operational example is given in which a negative pulse of duration 20 ms follows a DC positive current signal of duration 180 ms, equivalent to a positive duty cycle of 90%. This waveform has a frequency of only 5 Hz, far outside of the usual range of AC operation, which is typically two orders of magnitude higher in frequency. Foley et. al. disclose an operational mode for high duty cycle operation (90% positive duty cycle) requiring at least 50 cycles of this high duty cycle wave form during the charging time of a photoconductor moving under the charger, in order to avoid strobing.

There exists a need for an improved method of suppressing sheeting defects in positive corona wire charging, especially for high throughput copiers. There also exists a need for an improved method of suppressing sheeting defects from positive charging using a gridded charger (scorotron). The present invention provides such improvements.

SUMMARY OF THE INVENTION

The invention provides an improved means and method of positive corona charging a charge retentive surface such as for use in electrostatographic recording. An AC corona charger, preferably although optionally having a control grid, is used to suppress image defects known as "sheeting". The charger is operated at positive duty cycles with an AC voltage signal applied to the charger wire or coronode. A DC offset voltage, preferably positive, may be used in conjunction with the AC component of the signal. Preferably, the DC offset voltage is small enough so that corona emission is produced in both polarities.

In accordance with a first aspect of the invention, there is provided a corona charger for depositing an electrostatic charge on a charge retentive surface, without the creation of sheeting defects, the charger comprising a coronode; and a power supply operating in cycles and providing in each of the cycles electrical power to the coronode to produce a net positive charging current with voltage to the coronode from the power supply operating in a portion of each cycle with a positive polarity to generate positive corona emissions, the power supply operating so that an AC component of the voltage provided by the power supply has a positive polarity in the range of about 60% to about 85% of each cycle.

In accordance with a second aspect of the invention, there is provided a corona charger for depositing an electrostatic charge on a charge retentive surface, without the creation of sheeting defects, the charger comprising a coronode; a power supply operating in cycles and providing in each of the cycles electrical power with voltage to the coronode from the power supply operating in each cycle with a positive polarity to generate positive corona emissions and a negative polarity to generate negative corona emissions, the power supply operating so that an AC component of the power supply has a positive polarity for more than 50% but less than 100% of each cycle; and a controller monitoring DC equivalent current to the coronode to maintain DC equivalent current below a value to prevent sheeting.

In accordance with a third aspect of the invention, there is provided a corona charging apparatus for depositing an electrostatic charge on a charge retentive surface without the creation of sheeting defects, the apparatus comprising a coronode; a power supply operating in cycles and providing in each of the cycles electrical power to the coronode with voltage to the coronode from the power supply operating in each cycle with a positive polarity to generate corona emissions and a negative polarity to generate corona emissions, the power supply operating within a range defined by $x \geqq 5.5$, $y < -10.95x + 185.5$, $50\% < y < 100\%$ wherein y is duty cycle in percent of positive polarity operation of the AC component of the power supply and x is positive peak voltage in kilovolts to the coronode.

BRIEF DESCRIPTION OF THE DRAWINGS

Other aspects of the present invention will become apparent as the following description proceeds and upon reference to the drawings in which.

DETAILED DESCRIPTION OF THE PREFERRED EMBODIMENTS

Because corona chargers and electrostatographic reproduction apparatus are well known, the present description will be directed in particular to elements forming part of, or cooperating directly with, the present invention. Apparatus not specifically shown or described herein are selectable from those known in the prior art.

Figure 1:
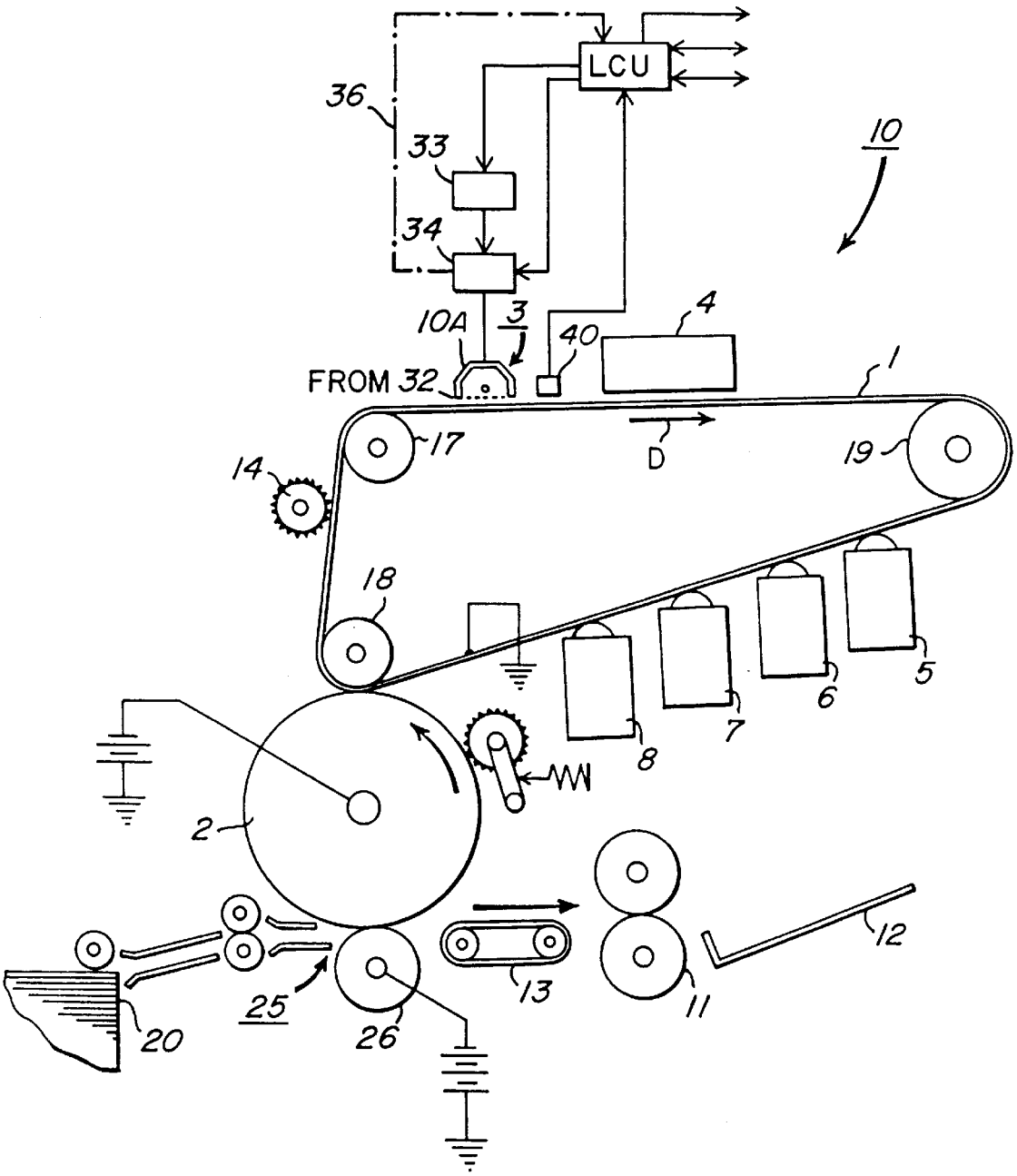
FIG. 1 is a side elevational view in schematic of a color printer apparatus utilizing the invention.

FIG. 1 illustrates one form of electrostatographic apparatus in which the invention is intended to be used. The apparatus 10 includes a primary image member, for example, a photoconductive web 1 trained about rollers 17, 18 and 19, one of which is drivable to move image member 1 in the direction shown by arrow D past a series of stations well known in the electrostatographic art. The primary image member may also be a drum. Primary image member 1 is uniformly charged at a primary charging station 3 with a primary electrostatic charge of positive polarity. Control of the voltage level on the member 1 may be monitored by an electrometer 40 and signals therefrom input to a logic and control unit (LCU) to control operating parameters of the charger as described herein. Thereafter the member 1 passes beneath an exposure station 4 and is image wise exposed, e.g., using an LED printhead or laser electronic exposure station or subject to an optical exposure to create an electrostatic image. The image is toned by one of toner stations 5, 6, 7 or 8 to create a toner image corresponding to the color of toner in the station used. The toner image is transferred from primary image member 1 to an intermediate image member, for example, intermediate transfer roller or drum 2 at a transfer station formed between roller 18, primary image member 1 and transfer drum 2. The primary image member 1 is cleaned at a cleaning station 14 and reused to form more toner images of different color utilizing toner stations 5, 6, 7 and 8. One or more additional images are transferred in registration with the first image transferred to drum 2 to create a multicolor toner image on the surface of transfer drum 2. A conductive backing layer coated below the photoconductive layer or layers (not shown) of the primary image member is grounded as shown or biased to a suitable voltage.

The multicolor image is transferred to a receiving sheet which has been fed from supply 20 into transfer relationship with transfer drum 2 at transfer station 25. The receiving sheet is transported from transfer station 25 by a transport mechanism 13 to a fuser 11 where the toner image is fixed by conventional means. The receiving sheet is then conveyed from the fuser 11 to an output tray 12.

The toner image is transferred from the primary image member 1 to the intermediate transfer drum 2 in response to an electric field applied between the core of drum 2 and a conductive electrode forming a part of primary image member 1. The multicolor toner image is transferred to the receiving sheet at transfer station 25 in response to an electric field created between a backing roller 26 and the transfer drum 2.

Alternatively, one or more images may be transferred from the primary image member to a receiver sheet directly as is well known.

Figure 2:
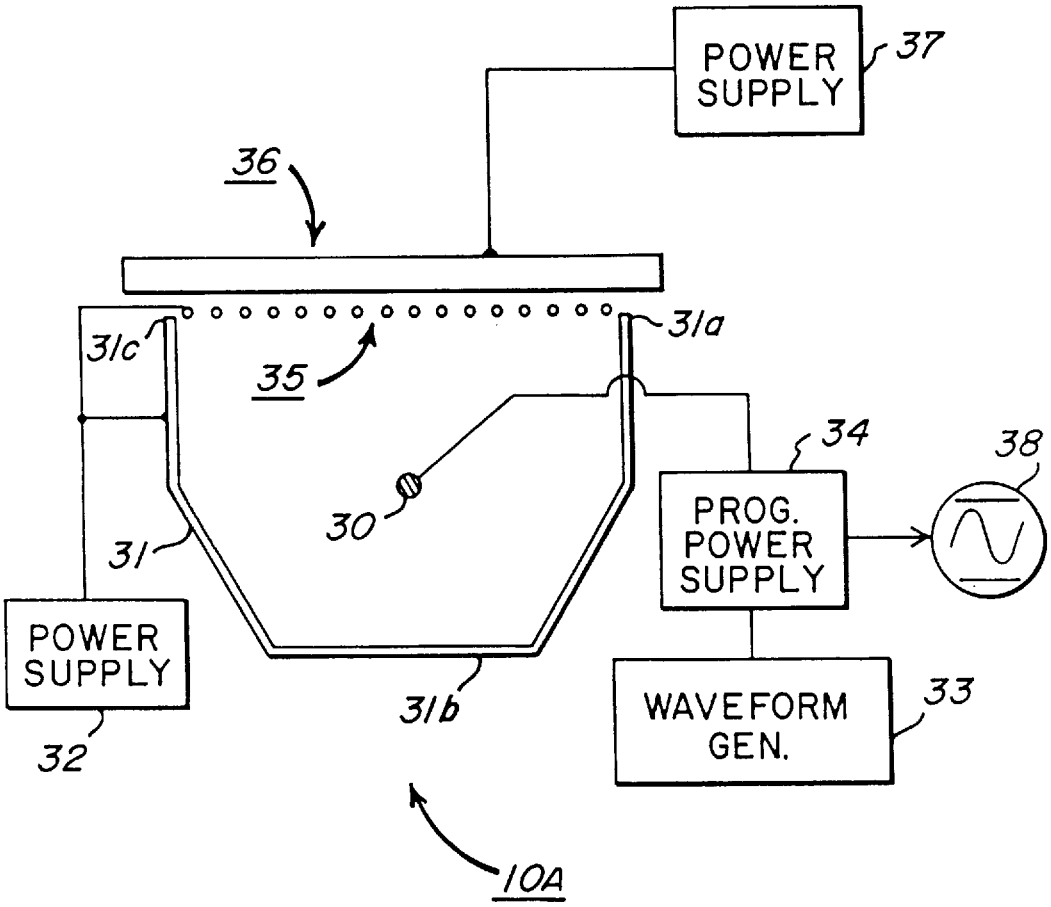
FIG. 2 is a schematic of a gridded corona charger or scorotron in accordance with a preferred embodiment of the invention.

With reference to FIG. 2, a corona charger 10A having a coronode formed of a bare wire 30 and also having a set of grid wires 35 is shown. In the Examples described below, the voltage to corona wire 30 was provided by a signal from a low voltage waveform generator 33 (Hewlett-Packard Model 3314A) amplified by a Trek Model 10/10 programmable power supply or amplifier 34. The low voltage signal from the waveform generator 33 consisted of a variable duty cycle square wave AC signal having peak positive voltage magnitude Vc combined with a controllable DC offset voltage, Voff. Because of to the finite slew rate of the Trek 10/10 amplifier 34, a high-ramp trapezoidal wave form was produced at the corona wires. At 50% duty cycle, approximately 89% of the voltage of each positive or negative excursion was at peak. The voltage ramp was approximately the same width and shape at all duty cycles (up to 95% duty cycle). Platinum alloy corona wire 30 (diameter 90 $\mu$m, composition 79% platinum, 15% rhodium, 6% ruthenium was situated approximately 0.9 cm below the top edges 31*a,* 31*c* of the shell 31, and 1.5 cm from the bottom 31*b* of the shell. The separation between the top edges 31*a,* 31*c* of the shell was approximately 2.4 cm, and the width of the floor or bottom 31*b* of the shell was about 0.9 cm. The minimum distance between corona wire 30 and grid 35 was approximately 1.0 cm. All geometric dimensions including number of grid wires are not critical to practice of the invention. Grid 35 and shell 31 were electrically connected and biased to a DC voltage by Trek Corotrol Model 610C power supply 32, which also measured the sum of the grid and shell currents. The shell and grid are preferably made of electrically conductive material such as metal; for example stainless steel. Other conductive materials may also be used. The shell may be made of insulating material instead of a conductive material.

FIG. 2 shows a configuration used with charger 10A to simulate primary charging of an uncharged photoconductor. The charger 10A is removed from the apparatus of FIG. 1 and positioned at a test bench for the various experiments discussed below. A glass plate electrode 36 having a transparent conductive coating to which electrical contact could be made (hereafter, plate) was mounted parallel to and spaced 1.5 mm from grid 35. Plate 36 was held at ground potential by Trek Corotrol Model 610C power supply 37, which also monitored the plate current. Visible observation of severe sheeting was done by looking through the transparent glass plate electrode with the charger operated in a dark room. The emission current waveform was monitored, at the current test point of the Trek Model 10/10 programmable power supply 34, by a Tektronix Model TDS 320 oscilloscope 38. Shell 31 was provided with a plurality of ventilation holes to allow fresh air to easily enter the charger, and to allow corona byproduct chemicals, such as ozone and oxides of nitrogen, to easily escape.

In application of the invention in an electrophotographic recording apparatus such as apparatus of FIG. 1, a photoconductive imaging member 1 would be located in the position of the glass plate 36. In such a recording apparatus, corona wire 30 and grid 35 would be powered by suitable power supplies delivering voltages and currents similar to those described in the Examples. Also, chargers having multiple wires may be used.

Charger 10A in Example 1 below was an as-manufactured, single-wire, gridded, primary positive charger with charging life of 145,000 copies, removed from a KODAK 1575 Copier Duplicator manufactured by Eastman Kodak Company, Rochester, N.Y. Charging current nonuniformity of 6.9% was measured along the length of the wire by a 1 mm wide scanning electrode at ground potential, using the technique described in Benwood, May and Pernesky. For Examples 2 and 3, a heavily used single-wire (non-gridded) pre-clean charger was removed from a commercial Kodak 1575 Copier Duplicator, and provided with hand-strung grid 35 (comprising 14 parallel wires, the same number of wires as in Ex. 1). The resulting charger geometry was almost identical to that of Ex. 1 This second charger had been previously operated in positive DC mode for 387,000 copies in a KODAK 1575 Copier Duplicator. Measured charging current nonuniformity by the scanning probe technique was 8.8%. The surfaces of both corona wires were heavily contaminated by silica dendrites which are typically found on aged wires.

Figure 10:
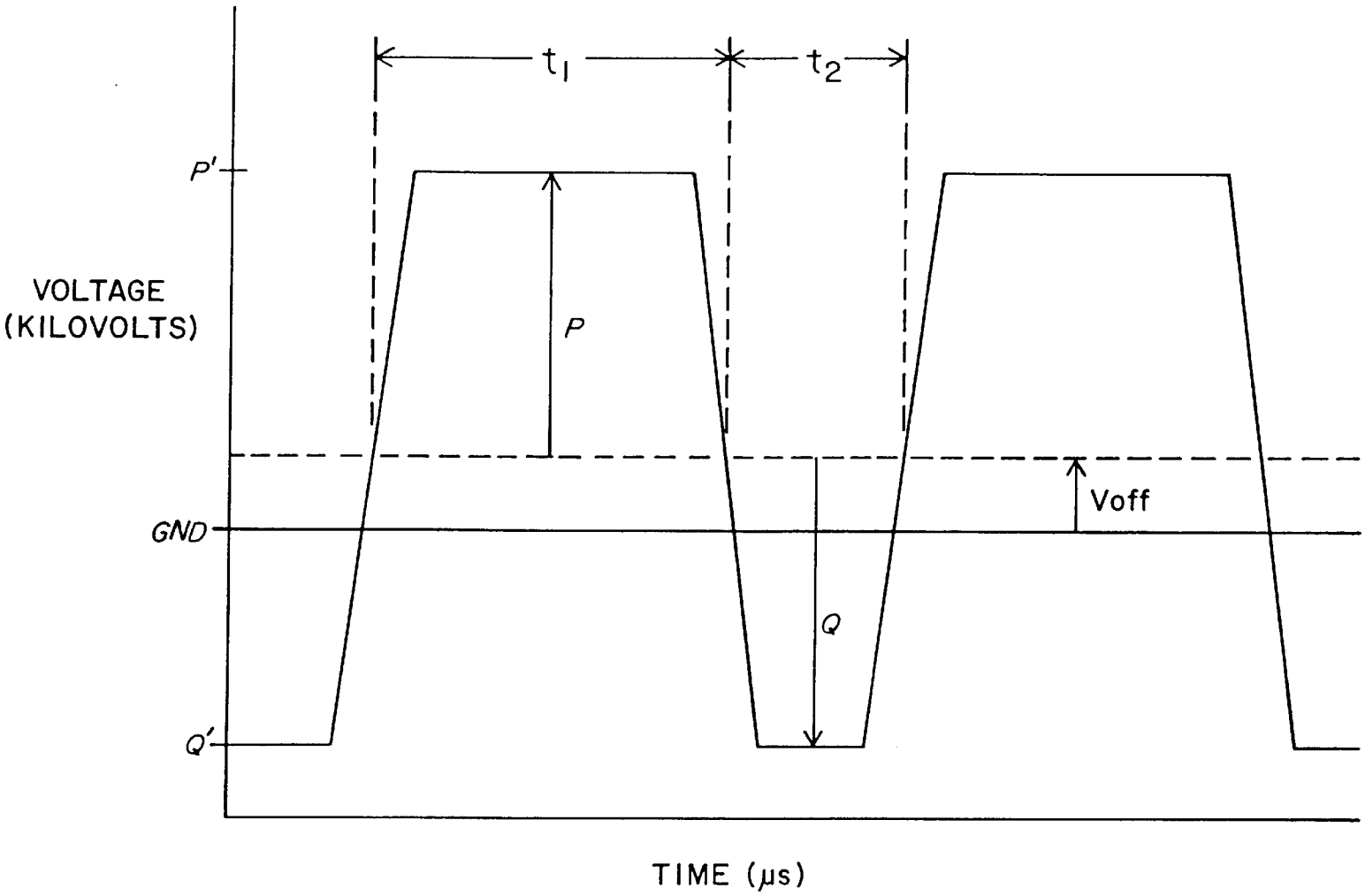

For all data in the Examples below, the Trek 10/10 supply 34 was operated in the constant voltage mode in order to establish voltage regimes delineating sheeting in single wire chargers. It has been discovered that sheeting pulses occur when a threshold voltage of the AC waveform is exceeded, said threshold voltage being dependent on the duty cycle of the waveform. Above threshold, if the peak voltage of the AC component is increased slightly or if the positive duty cycle is increased slightly, an excess emission current associated with the sheeting pulses is observed. At this point, the sheeting may not be detectable by eye, or perhaps a very weak light emission accompanies the sheeting pulses. A further small increase of either the peak voltage or the duty cycle usually produces a much brighter sustained glow discharge to nearby electrodes, e.g., shell or grid. This glow may be localized, e.g., near one spot on a wire, with streamer-like discharges appearing to connect wire and shield, or wire and grid. In severe cases, the glow may emanate radially from many spots along the entire wire length. When a sustained glow is seen, there is an accompanying significant increase of emission current. Moreover, if the voltage signal is maintained constant in the sustained glow condition, the emission current tends to increase with time (this may sometimes lead to arcing). Still further increases of peak voltage or duty cycle lead to immediate arcing, i.e., breakdown, with an associated very large increase of emission current. This is very undesirable. It is evident that if the sheeting threshold is exceeded for a significant time in constant voltage mode operation, voltage fluctuations or perhaps fluctuations in duty cycle may lead to positive feedback, i.e., a runaway emission current eventually producing an arc. Operating in constant current mode tends to prevent runaway currents leading to sustained glows or to arcing, because any tendency of the current to increase caused by sheeting (see Example 3 below) is actively countered by a reduction of the peak voltage from the power supply. In actual application of the invention, e.g., in an electrostatographic copier or printer, for example, a power supply operating in a constant current mode is preferred. The term constant current mode implies constant RMS corona emission current from the wire (which can be sensed or measured by an RMS current meter or sensor). It is also preferred that in an electrophotographic engine the positive duty cycle be in the approximate range 60% to 85%. It is also preferred that the power supply to the corona wire be operating to provide voltage to the wire with an AC trapezoidal waveform. With reference to FIG. 10, there is illustrated a trapezoidal waveform comprising an AC voltage component plus a positive DC offset voltage. Ground voltage is shown as the solid horizontal line labeled GND. The AC component has positive and negative peak voltages measured from the dotted horizontal line. The magnitudes P and Q are equal, and Q=P. The peak positive voltage P' is measured from ground, and is equal to Voff plus P, where Voff is the positive DC offset voltage. The peak negative potential Q' is equal to Q plus Voff; i.e., −P plus Voff and the magnitude of B' is less than that of P'. In the experiments described herein, Q' is large enough to excite negative corona. Also, as used herein, duty cycle refers to the AC component of the waveform and thus does not change with a change in DC offset voltage. In FIG. 10, intersections of the AC component of the waveform with the dotted horizontal line define the positive duty cycle. The positive portion of the AC component lasts for a time $t_1$ and the negative portion for a time $t_2$ When $t_1>t_2$ the duty cycle is greater than 50%. The positive duty cycle, expressed as a percentage, is defined as $t_1$ multiplied by 100 and divided by $(t_1+t_2)$. FIG. 10 shows positive duty cycle of 67%. Herein, the condition 100% positive duty cycle means positive DC with no added AC component. The trapezoidal shape shown in FIG. 10 is illustrative of a waveform that can be used in the practice of the invention. Quasi-trapezoidal waveforms; e.g., with rounded rather than sharp corners, are more useful and are preferred and as used herein the term "trapezoidal" also implies "quasi-trapezoidal" waveforms, too. An AC component having a waveform other than trapezoidal and having positive duty cycle in the range greater than 50% to less than 100% may also be used.

All experiments were performed in a darkened environmental chamber in which the RH was maintained at 10% and the temperature at 80° F. These conditions, especially low RH, favor observation and study of sheeting. The invention, however, may be practiced over wide ranges of humidity and temperature, and is not limited to the specific values used in the Examples. By employing an optimal voltage waveform to suppress sheeting under very low RH conditions, sheeting is automatically controlled at higher RH.

EXAMPLE 1

Onset Of Sheeting Revealed By Oscilloscope

Charger Age=145,000 Copies

This Example illustrates the onset of sheeting as monitored by oscilloscope 38 using the setup of FIG. 2, with spacing between grid and glass electrode=1.5 mm, corona wire charger AC voltage Vc=7.5 KV (power supply 34 in constant voltage mode), Vgrid=Vshell=+600 V, and the DC offset voltage to the charger Voff=0.

Figure 3A:
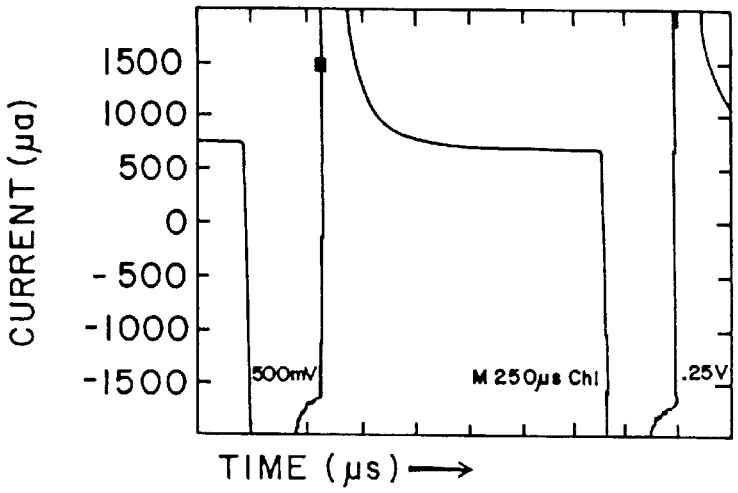
FIGS. 3*a*–3*e* are illustrations of oscilloscope traces of emission current in accordance with various duty cycles of voltage to a corona wire in the scorotron of FIG. 2.
Figure 3B:
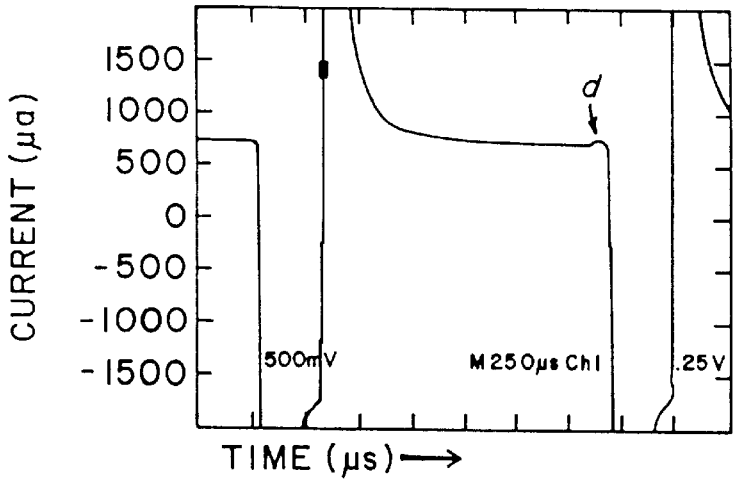
Figure 3C:
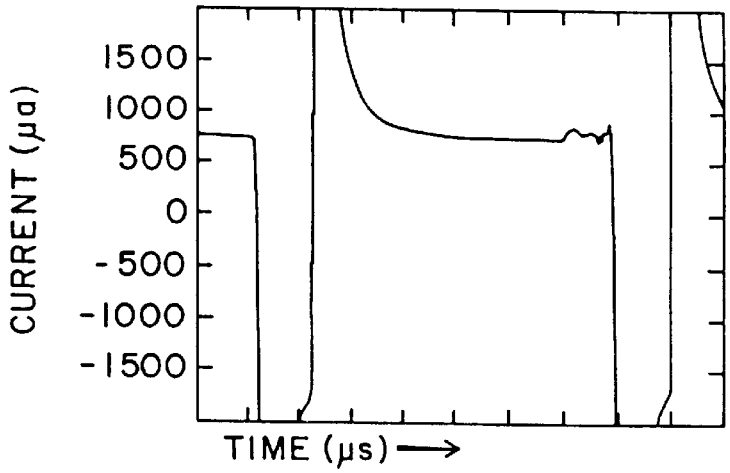
Figure 3D:
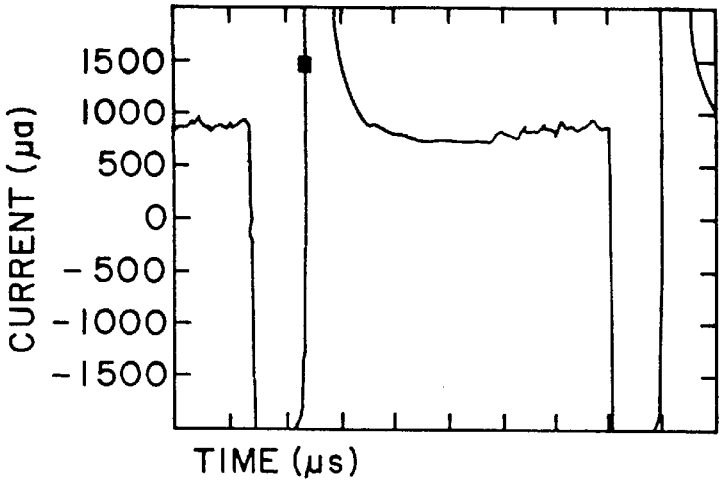
Figure 3E:
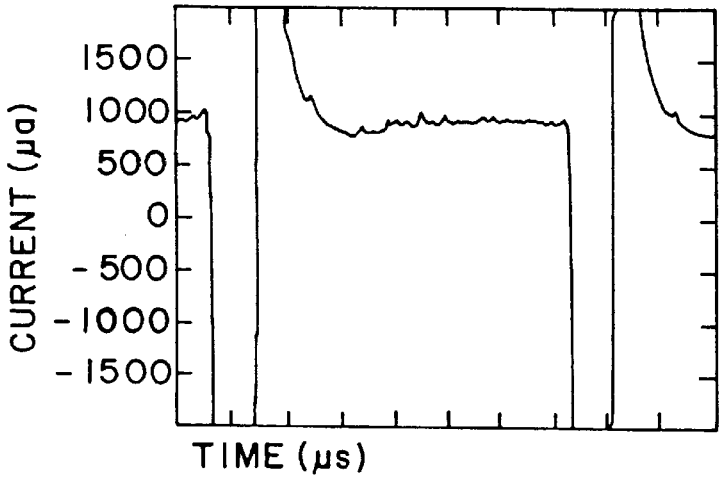

FIG. 3*a* shows an oscilloscope trace of current versus time, measured at the current test point of the Trek 10/10 power supply 34. The positive duty cycle is 80%. Time is measured from left to right (250 μs per large division). The unit of current is 500 μa per large division, and the horizontal center line is zero current. At the start of each positive excursion, there is a displacement current spike which decays to a constant positive current of approximately 720 μa. Similarly, at the start of each negative excursion, there is a displacement current spike which decays to about −1700 μa before the polarity reverses. No discernible sheeting was observed for the conditions of FIG. 3*a,* at 80% duty cycle. Onset of sheeting is first evident in FIG. 3*b* for which the duty cycle was increased to 82%. Although nothing as yet was observed by eye through the transparent glass electrode 36, the oscilloscope trace shows a slight disturbance d just before the polarity reverses from positive to negative. At 83% duty cycle, the beginning of visible sheeting was noticed for a cluster of sites along about an inch or so of the corona wire, near one end. With further increases of the duty cycle, more sheeting sites developed on the wire, and more and more disturbance of the trace was observed, as shown in FIGS. 3*c*–3*e,* and summarized in Table I. Note that this disturbance occurs earlier in time as duty cycle is raised, and that the integrated positive current also increases steadily. It is clear from Table I, column 2, that the plate current (charging current) increases superlinearly as duty cycle is raised, rather than linearly which would be expected from increase of duty cycle alone. The total time-averaged grid current plus time-averaged shield current also increases superlinearly (third column), rather than linearly as would be similarly expected. Both of these superlinearities may be associated with excess current flowing in sheeting pulses. At 88% duty cycle the entire waveform is disturbed (FIG. 3*e*), there is a sustained visible discharge, and arcing is imminent.

This example demonstrates that visual monitoring of the total corona emission current waveform on an oscilloscope screen is an accurate way to measure the occurrence of sheeting, as well as the sheeting threshold.

TABLE I

| Onset Of Sheeting | | | | |
|---|---|---|---|---|
| Duty Cycle (%) | Plate Current (μa) | Grid Plus Shield Currents (μa) | FIG. | Comment |
| 80 | 82 | 189 | 3a | No sheeting |
| 82 | 84 | 233 | 3b | First very faint sheeting at 83% |
| 84 | 86 | 288 | 3c | Quite noticeable sheeting |
| 86 | 90 | 363 | 3d | Strong sheeting |
| 88 | 94 | 448 | 3e | Arcing imminent |

EXAMPLE 2

Duty Cycle Dependence of Sheeting Threshold Voltage

Charger Age=387,000 Copies

A series of experiments was done using the configuration of FIG. 2 (grid to glass electrode spacing=1.5 mm, Vshell=Vgrid=+600 volts) to find the effect of duty cycle on sheeting threshold voltage. For each experiment, a value of the peak voltage of the AC component of the corona wire charger voltage, Vc, was set, as well as a charger DC offset voltage, Voff. Starting at 50% positive duty cycle, the duty cycle was systematically increased in steps of 5% with visual observations of the corona wire through the transparent glass electrode. When visual sheeting was first observed (for each Vc and Voff combination) the strength of the sheeting was recorded (e.g., "momentary", "threshold", "steady", "heavy", "very heavy", etc.). Locating the threshold duty cycle was also sometimes aided by the oscilloscope technique of Example 1. The results of these observations are listed in Table II, where it may be seen that as peak voltage Vc increases with Voff held constant, or as Voff is made more positive with Vc held constant, the threshold duty cycle for sheeting decreases. Also, Table II shows that as (Vc+Voff) increases, threshold duty cycle for sheeting decreases.

Figure 4:
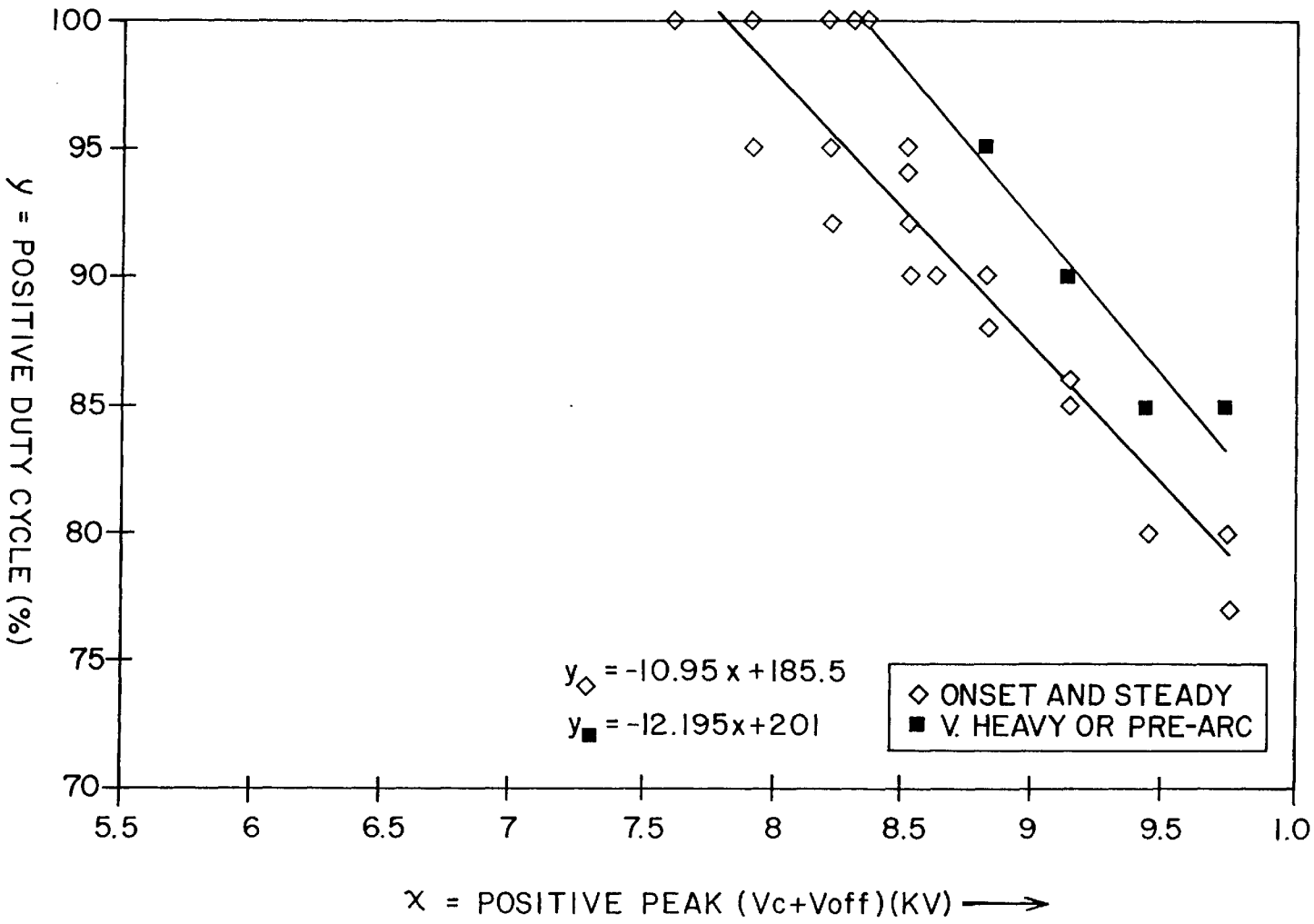
FIGS. 4–10 are graphs that are descriptive of operation of the corona chargers of the invention.

It was determined from analysis of the data of Table II that duty cycles recorded for "threshold" or "steady" sheeting could not be statistically differentiated. This is because there is quite a sharp transition between threshold and steady sheeting as duty cycle is increased. On the other hand, the data for "very heavy" sheeting or pre-arcing conditions were clearly differentiated from the other data. Therefore, two linear regression lines are shown in FIG. 4, in which critical values of duty cycle are plotted against peak positive voltage of the corona wire charger (Vc+Voff). The choice of the variable (Vc+Voff) for the abscissa of FIG. 4 results in co-linearization of data, independent of Voff. (There is no such co-linearization when the abscissa is chosen to be Vc, although there is a separate linear relation for each value of Voff). The lower line of FIG. 4 is an approximate sheeting threshold demarcation line. The critical duty cycle Ø* is given by equation (1), in which both Vc and Voff are in KV. Below this line, sheeting to all extents and purposes is not observed.

Sheeting demarcation duty cycle $$Ø^*(\%)=-10.95\ (Vc+Voff)+185.5 \quad (1)$$

The upper regression line (FIG. 4) represents very heavy sheeting or pre-arc conditions, for which the critical duty cycle Ø** is given by equation (2):

Very heavy (pre-arcing) sheeting duty cycle $$Ø^{**}(\%)=-12.195\ (Vc+Voff)+201.6 \quad (2)$$

Bearing in mind that the relations given by equations (1) and (2) will have slopes and intercepts that are functions of RH and temperature, and that these slopes and intercepts will vary from one charger to another, and will also vary with charger geometry, this Example demonstrates that the duty cycle for onset or steady sheeting is linearly dependent on the peak positive voltage of a trapezoidal waveform applied to a corona wire of a scorotron. Conversely, it may be concluded that the peak positive voltage at threshold is a linear function of the duty cycle at which a scorotron is operated. Hence, to operate a charger in a manner as to preclude sheeting, it is necessary to keep the peak positive voltage (Vc+Voff) below a predetermined value, which for example might be 500 volts less positive than the voltages described by the lower of the regression lines of FIG. 4. Thus it is shown that relatively elevated positive peak voltages to the coronode may be used at various duty cycles when operating in the range $x \geqq 5.5$, $y < -10.95x+185.5$ wherein y is duty cycle in percent of positive polarity operation of the AC component of the voltage provided by the power supply and $50\% < y < 100\%$ and wherein x is positive peak voltage in kilovolts to the coronode and wherein the power supply operates in cycles, with a cycle having a positive polarity wherein corona emissions are generated and the power supply operates at negative polarity and preferably generates corona emissions when operating in a negative polarity.

Moreover, it is known that sheeting of corona wires gets progressively worse as corona wires age in a copying machine. This means that sheeting threshold peak positive voltage, for a given value of duty cycle, falls as a corona wire ages. By measuring the relationship between peak positive sheeting threshold voltage and age (not reported here) it is possible to choose a combination of duty cycle and peak positive voltage that will co-optimize charger life and charging efficiency.

TABLE II

Sheeting Observations (Example 2)
Dependence On Peak Voltage And DC Offset
With Grid, With Transparent Glass Plate Electrode

| Voff (KV) | Vc (KV) | (Vc + Voff) (KV) | Positive Duty Cycle (%) | Comment |
|---|---|---|---|---|
| 0 | 7.9 | 7.9 | 95 | threshold |
| 0 | 8.2 | 8.2 | 92 | threshold |
| 0 | 8.2 | 8.2 | 95 | heavy |
| 0 | 8.5 | 8.5 | 90 | momentary |
| 0 | 8.5 | 8.5 | 92 | threshold |
| 0 | 8.5 | 8.5 | 95 | heavy |
| 0.6 | 7.3 | 7.9 | 95 | sheeting |
| 0.6 | 7.6 | 8.2 | 95 | sheeting |
| 0.6 | 7.9 | 8.5 | 90 | momentary |
| 0.6 | 7.9 | 8.5 | 94 | steady |
| 0.6 | 8.2 | 8.8 | 88 | momentary |
| 0.6 | 8.2 | 8.8 | 90 | steady |
| 0.6 | 8.2 | 8.8 | 95 | v.strong, arced 1 min |
| 0.6 | 8.5 | 9.1 | 85 | threshold |
| 0.6 | 8.5 | 9.1 | 90 | v.heavy |
| 1.2 | 7.3 | 8.5 | 95 | momentary |
| 1.2 | 7.6 | 8.8 | 90 | steady |
| 1.2 | 7.6 | 8.8 | 95 | v.heavy, arced 30 sec |
| 1.2 | 7.9 | 9.1 | 86 | steady |
| 1.2 | 7.9 | 9.1 | 90 | v.heavy |
| 1.2 | 8.2 | 9.4 | 80 | momentary |
| 1.2 | 8.2 | 9.4 | 85 | v.strong, arced 1 min |
| 1.2 | 8.5 | 9.7 | 77 | flicker sheeting |
| 1.2 | 8.5 | 9.7 | 80 | strong |
| 1.2 | 8.5 | 9.7 | 85 | v.heavy, arced l0 sec |
| pos DC | 7.6 | 7.6 | 100 | threshold |
| pos DC | 7.9 | 7.9 | 100 | steady |
| pos DC | 8.2 | 8.2 | 100 | steady |
| pos DC | 8.31 | 8.31 | 100 | threshold |
| pos DC | 8.35 | 8.35 | 100 | threshold |

EXAMPLE 3

Longer Charger Life

Charger Age=387,000 Copies

Spacing=1.5 mm, Vshell=Vgrid=+600 volts

Using the same charger as in Example 2, this Example provides evidence that charging with a positive duty cycle of approximately 70%–80% using a gridded charger of the present type results in longer operational charger life for a given charging current.

Figure 5:
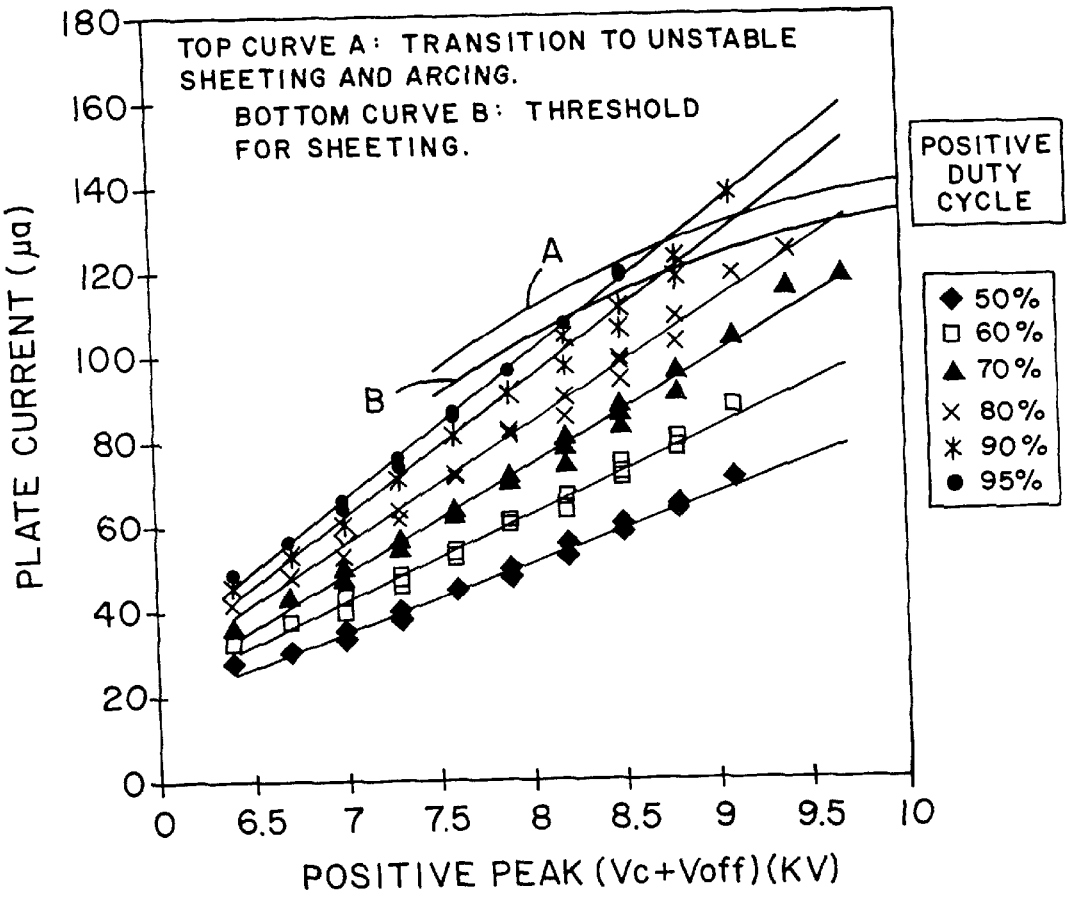

FIG. 5 shows a set of straight line relationships illustrating linear dependence of plate current, Ip, upon maximum positive peak excursion (Vc+Voff). As for Ex. 2, the plate was at ground potential, Vgrid=Vshell=600 V, grid to glass electrode spacing 1.5 mm). Each straight line is for a different duty cycle, and is a least squares fit. The slopes, m, and the plate current (Ip) axis intercepts, b, are both linear functions of percent positive duty cycle, given by the following linear regression relationships:

$$m=0.402Ø-2.947 \quad (3)$$

$$b=-2.125Ø+21.896 \quad (4)$$

where Ø is duty cycle (%), m has units of $\mu$a(KV)−1, and b has units of $\mu$a. The straight lines themselves have the general formula $$Ip=(m)(Vc+Voff)+b \quad (5)$$

where (Vc+Voff) is in KV, and Ip, the plate current, is in microamperes. By combining equations (3), (4) and (5) with equation (1) from the previous Example, one can derive equations (6) and (7) for the threshold plate current Ip* in microamperes:

Plate current for threshold up to steady sheeting:

$$Ip^*=-372.3+94.89\ (Vc+Voff)^*-4.402[(Vc+Voff)^*]^2 \quad (6)$$

$$Ip^*=-28.02+4.684Ø^*-0.03671\ (Ø^*)^2 \quad (7)$$

where the starred quantities Ø* and (Vp+Voff)* are approximate sheeting threshold values (transition from threshold to steady sheeting is quite abrupt).

Similarly, by combining equations (3), (4) and (5) with equation (2) one obtains Plate current for very heavy or pre-arcing sheeting:

$$Ip^{}=-406.5+104.0\ (Vc+Voff)^{}-4.902\ [(Vc+Voff)^{**}]^2 \quad (8)$$

$$Ip^{}=-26.82+4.762Ø^{}\ -0.03296(Ø^{**})^2 \quad (9)$$

*=threshold up to steady sheeting

**=very heavy or pre-arcing

Equations (6) and (8) have been plotted as the calculated curved lines B and A respectively in FIG. 5. Plate current (charging current to an uncharged photoconductor) for the condition of approximate visual sheeting threshold is predicted as a function of positive duty cycle by the lower curve. Similarly, the upper curve is the prediction curve for very heavy sheeting or pre-arcing. FIG. 5 demonstrates that as duty cycle is reduced, higher plate currents can be obtained without sheeting. Moreover, this improvement is quite steep if duty cycle is dropped from 95% to about 80%. The cost of this reduction is a modest increase of peak voltage of about 1.5 KV, and it is to be understood that an operating positive peak voltage in this case of about 9.5 KV is quite practical for charger operation. One may also think of FIG. 4 in terms of some desired plate current. For example, if operational Ip were required to be, say, 105 $\mu$a, then at 100% duty cycle (i.e., for positive DC, the prior art operational condition) the present aged corona wire is predicted to exhibit sheeting. However, at 80% duty cycle, there is a comfortable margin for operating without sheeting at 105 $\mu$a.

Figure 6:
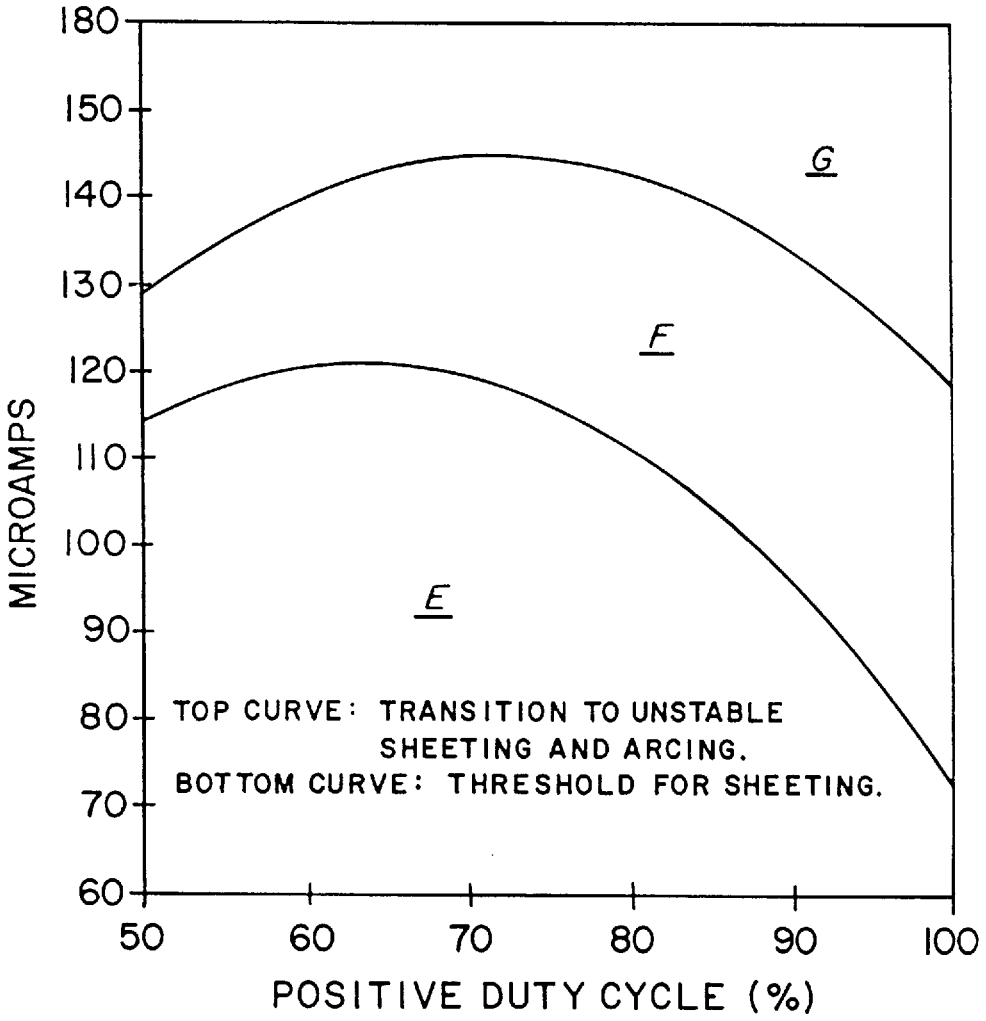

Equations (7) and (9) are plotted as the two curves in FIG. 6. Plate current (initial charging current of uncharged photoconductor) at approximate visual sheeting threshold is predicted as a function of positive duty cycle by the lower curve. Similarly, the upper curve describes very heavy sheeting or pre-arcing. Thus, region E defines conditions where there is no visual sheeting, region F moderate to heavy sheeting, and region G unstable sheeting or actual arcing.

The curves corresponding to equations (7) and (9) show maxima at duty cycles of about 64% and 72% respectively. Operating near these duty cycles can provide practical charging currents (well below sheeting threshold) at voltages that are not unreasonably high. For example, choosing Ip=105 $\mu$a at 69% duty cycle, one calculates from equations (3–5) that peak positive wire potential is 9.27 KV. This is about 620 volts lower than the value of 9.89 KV calculated for the sheeting threshold at 69% duty cycle, for which Ip* is about 120 $\mu$a. On the other hand, for conventional AC operation at 50% duty cycle, a peak positive wire potential of 11.04 KV is needed to produce the same 105 $\mu$a of charging current. While use of this low duty cycle would probably avoid sheeting for any age of wire, the lower impedance at 50% duty cycle requires undesirably high wire potentials (in this case, 11.04 KV) which may result in arcing.

To more fully understand FIG. 6, one must consider the experimental fact that sheeting is rarely, if ever, observed for new corona wires. Thus for a new wire, a sheeting threshold demarcation line probably does not exist experimentally for any plate current at 10% RH (although it may do so under extremely dry conditions, say 5% RH), and the upper limit of plate current from a new wire (for a high duty cycle and/or a high peak voltage) is actually determined by direct arcing, with no separate sheeting condition being measurable. It is clear that, as a wire ages, the demarcation line for sheeting threshold will move down to lower plate currents, and the separation between sheeting threshold (lower line in FIG. 6) and unstable sheeting (upper line in FIG. 6) will become more pronounced. Moreover, the break points of FIG. 4, i.e., the lowest DC positive voltages at which sheeting threshold or pre-arcing occurs for a given wire, are dependent on wire age. These breakpoints will move to lower and lower peak positive voltages as a corona wire ages. If this lowering is proportional to charger age, then FIG. 5 can be interpreted to mean that operating at 70% duty cycle should increase the life of the example charger by the approximate ratio of the currents, i.e., 120÷72, or about 67%.

This Example demonstrates that high duty cycle AC charging is more robust against undesirable sheeting artifacts than prior art positive DC charging. By operating in a preferred range of duty cycle between about 60% to about 85%, and more preferably between about 70% to 80%, the useful life of corona wires employed for positive charging can be extended significantly, while operating with moderate positive peak voltages, typically in the approximate range of 7 to 9 KV, although lower or higher peak voltages may be employed as appropriate.

EXAMPLE 4

Constant Time-Averaged Integrated Emission Current at Sheeting Threshold

Charger Age=387,000 Copies

Spacing=1.5 mm, Vshell=Vgrid=+600 volts

Approximate peak positive emission currents I(pk+) and approximate peak negative emission currents I(pk−) were recorded (to the nearest 0.05 ma) from visual inspection of corresponding oscilloscope traces when the data in Table II were being collected. At the same time, the total (time-averaged). emission current Ic was measured at the test point of the Trek 10/10 power supply 34. The data are collected in Tables III and IV. The time-averaged emission current is the DC equivalent corona emission current.

TABLE III

| (Vc + Voff) (KV) | Positive Duty Cycle (%) | I(pk+) Scope (ma) | I(pk−) Scope (ma) | Measured Ic (ma) | Calculated Ic (ma) |
|---|---|---|---|---|---|
| | | Sheeting Currents Threshold and Steady Sheeting | | | |
| 7.9 | 95 | 0.60 | −2.5 | 0.509 | 0.445 |
| 7.9 | 95 | 0.55 | −1.3 | 0.5 | 0.458 |
| 7.9 | 100 | DC | DC | 0.722 | Not applicable |
| 8.2 | 92 | 0.65 | −2.7 | 0.407 | 0.382 |
| 8.2 | 95 | 0.65 | −1.5 | 0.588 | 0.543 |
| 8.2 | 100 | DC | DC | 0.6 | Not applicable |
| 8.31 | 100 | DC | DC | 0.642 | Not applicable |
| 8.35 | 100 | DC | DC | 0.65 | Not applicable |
| 8.5 | 90 | 0.75 | −2.9 | 0.474 | 0.385 |
| 8.5 | 92 | 0.75 | −2.9 | 0.556 | 0.458 |
| 8.5 | 90 | 0.70 | −1.85 | 0.538 | 0.445 |
| 8.5 | 94 | 0.70 | −1.85 | 0.738 | 0.547 |
| 8.5 | 95 | 0.70 | −1.1 | 0.685 | 0.610 |
| 8.8 | 88 | 0.80 | −2.1 | 0.549 | 0.452 |
| 8.8 | 90 | 0.80 | −2.1 | 0.779 | 0.510 |
| 8.8 | 90 | 0.80 | −1.2 | 0.687 | 0.600 |
| 9.1 | 85 | 0.95 | −2.3 | 0.533 | 0.463 |
| 9.1 | 86 | 0.95 | −1.4 | 0.722 | 0.621 |
| 9.4 | 80 | 1.10 | −1.6 | 0.541 | 0.560 |
| 9.7 | 77 | 1.20 | −1.95 | Not Recorded | 0.476 |
| 9.7 | 80 | 1.20 | −1.95 | 0.738 | 0.570 |
| | | | Means | 0.608 | 0.501 |
| | | | Std Devs | ±0.023 | ±0.018 |

TABLE IV

| (Vc + Voff) (KV) | Positive Duty Cycle (%) | I(pk+) Scope (ma) | I(pk−) Scope (ma) | Measured Ic (ma) | Calculated Ic (ma) |
|---|---|---|---|---|---|
| | | Sheeting Currents Heavy and Pre-Arcing | | | |
| 8.2 | 95 | 0.65 | −2.7 | 0.629 | 0.483 |
| 8.5 | 95 | 075 | −2.9 | 0.821 | 0.700 |
| 8.8 | 95 | 0.80 | −1.2 | 0.993 | 0.568 |
| 8.8 | 95 | 0.80 | −1.2 | 0.94 | 0.625 |
| 9.1 | 90 | 0.95 | −2.3 | 0.829 | 0.715 |
| 9.1 | 90 | 0.95 | −1.4 | 0.93 | 0.700 |
| 9.4 | 85 | 1.10 | −1.6 | 0.878 | 0.695 |
| 9.7 | 85 | 1.20 | −1.95 | 1.05 | 0.728 |
| | | | Means | 0.884 | 0.652 |
| | | | Std Devs | ±0.046 | ±0.031 |

The calculated values of Ic in Tables III and IV were obtained using the approximate formula of equation (10) below, assuming a square waveform:

$$Ic(calc)=0.01\ \{(Ø)[I(pk+)]+(100-Ø).[I(pk-)]\} \quad (10)$$

where Ø is positive duty cycle (%). No correction has been made to account for the actual trapezoidal waveform. It is seen that the calculated values of Ic are generally smaller than the measured values. To account for the trapezoidal wave shape, one may correct equation (10) in approximate fashion by subtracting 7.3% from each value of Ø, or by subtracting 7.3% from each value of (100−Ø) and replacing negative values of (92.7−Ø) by zero. The resulting means and standard deviations for Ic(calculated) then become 0.574±0.012 ma for threshold and steady sheeting, and 0.702±0.023 ma for heavy or pre-arcing sheeting. These numbers are in much better agreement with the measured Ic values, and have smaller standard deviations as well.

Figure 7:
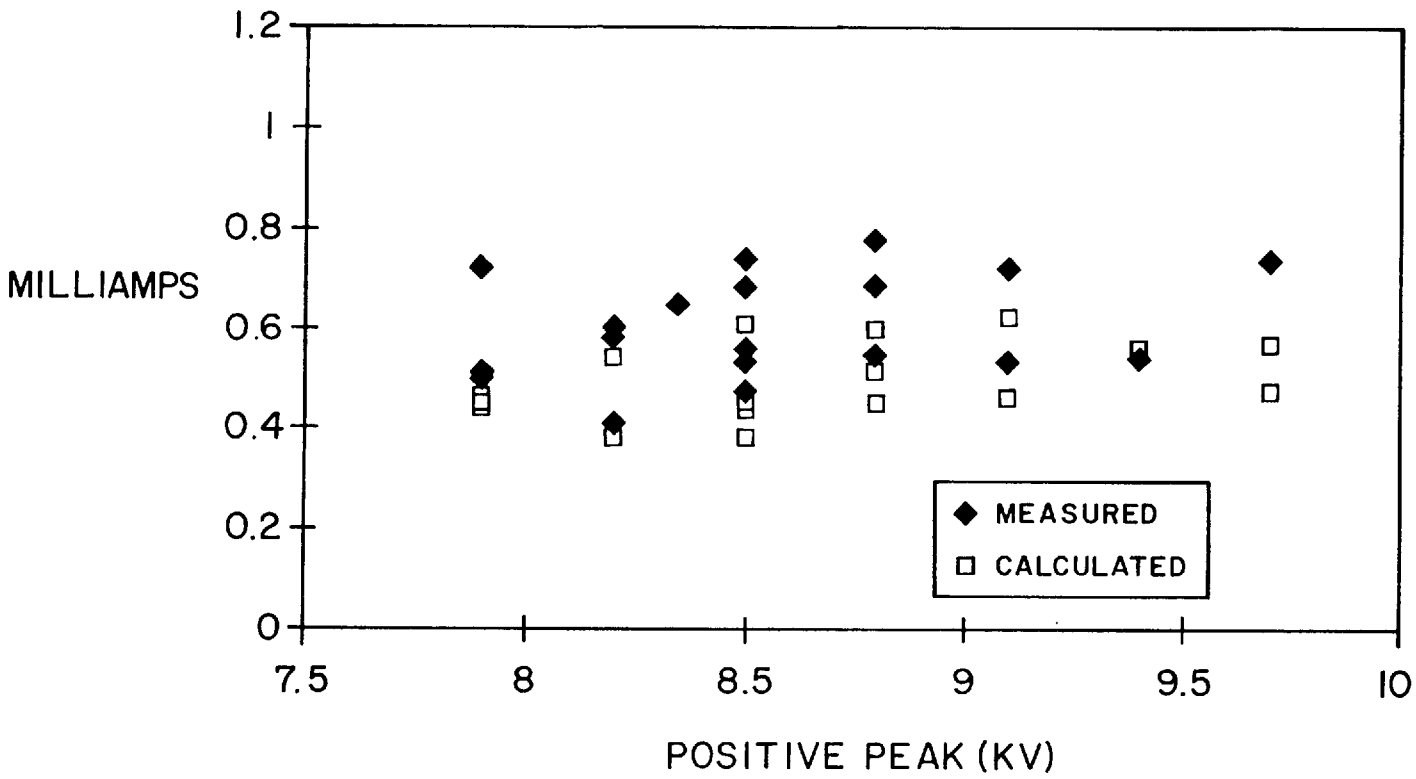
Figure 8:
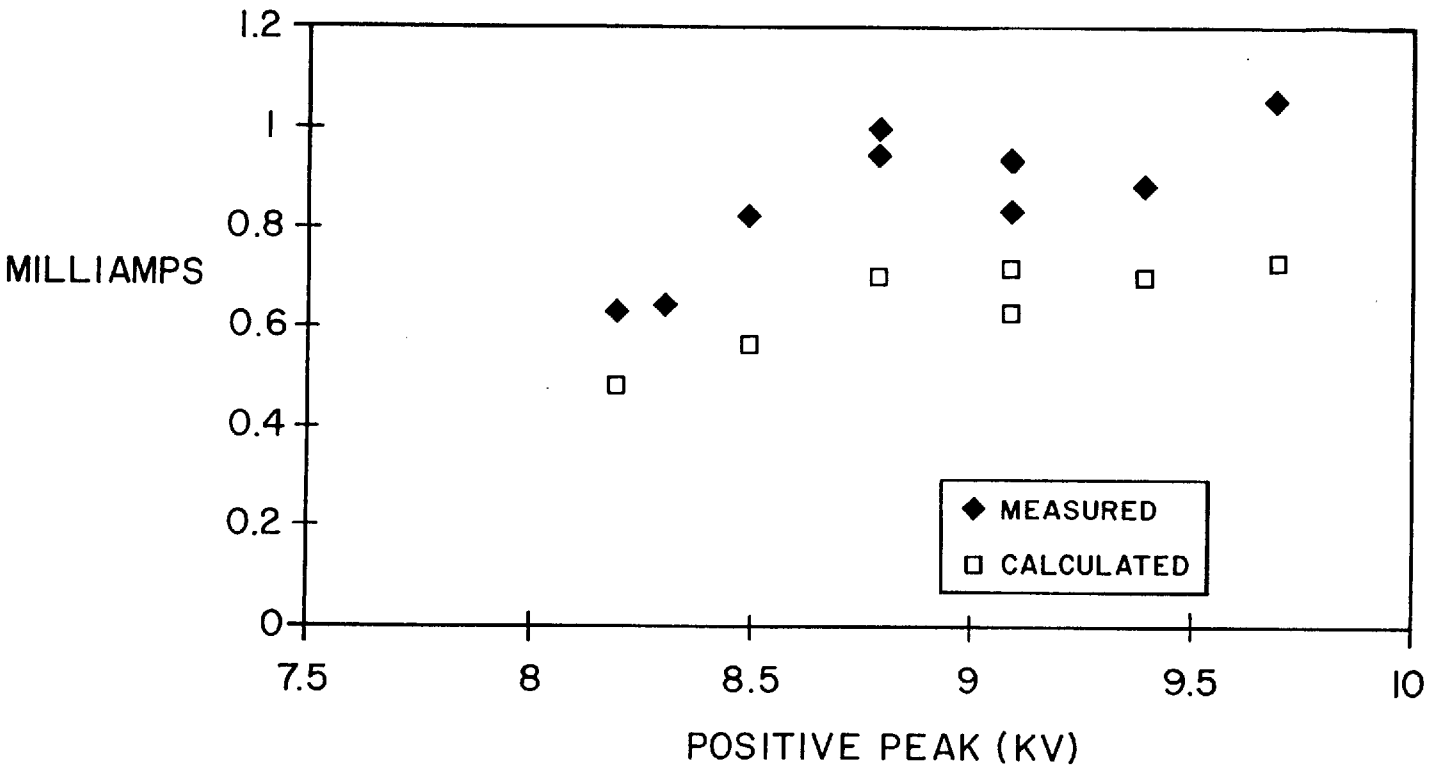

As shown by Table III and FIG. 7, the time-averaged total emission current (DC equivalent current) for threshold and steady sheeting, as determined by the oscilloscope technique, is essentially independent of duty cycle, AC peak to peak voltage, and DC offset, either separately or in combination. This is also approximately true for heavy or pre-arc sheeting (Table IV) although the data exhibit considerably more scatter, and there is also a weak tendency (FIG. 8) for the heavy or pre-arc sheeting current to increase with increasing positive peak voltage, (Vc+Voff). For this Example, experimental DC equivalent currents were found respectively to be about 610±20 μa for threshold and steady sheeting, and about 880±50 μa for heavy or pre-arc sheeting. For the coronode of this Example, these DC equivalent currents correspond to about 19±0.6 μa per lineal centimeter and about 28±1.6 μa per lineal centimeter, respectively.

It is shown that sheeting threshold occurs when a critical DC equivalent emission current is exceeded, indicating that DC equivalent emission current may be a useful feedback parameter for controlling sheeting in a copier. For example, a feedback circuit that adjusts duty cycle or peak positive voltage (either Vc, Voff, or both) may be used to keep measured DC equivalent emission current at some predetermined amount below such a predetermined threshold value, bearing in mind that the total time-integrated threshold emission current is a quantity that is expected to be different in different chargers having different geometries or dimensions, different corona wire materials, different wire diameters, etc. In the example illustrated, successful operation is provided wherein the AC component of the power supply has a positive polarity for more than 50% but less than 100% of each cycle, DC equivalent current to the coronode is less than 800 μamps and peak positive voltage to the coronode is less than 11 kilovolts. This is particularly useful for relatively higher peak voltages above 5.5 kilovolts. In this regard and with reference to FIG. 1, a signal over line 36 (shown in phantom) and representing DC equivalent emission current as measured or sensed by say an ammeter or other suitable sensor may be fed back to a logic and control unit (LCU) which controls either the entire controls of the apparatus as is well known or alternatively a separate controller may be provided for the power supply 33 to respond to a feedback signal. In an alternative mode of feedback, the LCU may be used to control the charging current by adjusting the grid bias, duty cycle and/or peak wire voltage, Also, both feedback modes could be used in conjunction. In lieu of a feedback signal, operation may be made at set points that would not produce the current level expected to create sheeting. The charger may employ multiple coronodes or wires and the DC equivalent current maximum is applicable to each wire.

EXAMPLE 5

Sheeting Observations for a Non-gridded Charger

No grid, No Plate

Charger age=387,000 copies

This Example demonstrates the importance of geometry, and also demonstrates that the invention is useful for a charger having no grid. The same charger configuration was used as in FIG. 2, except that grid 35, plate 36, power supply 37 and oscilloscope 38 were absent. The same wire was used as in Examples 2–4. Sheeting was monitored visually. Absence of plate 36 makes this Example not applicable to actual usage, inasmuch as no charging current was drawn from the charger. Nevertheless, it is significant because the results are similar to those of the previous Examples, with the following exceptions:

(a) For a constant value of (Vc+Voff) the duty cycle for sheeting threshold depended somewhat on Voff, declining as Voff was made more positive.

(b) Specifically, for (Vc+Voff)=8.0 KV, the positive duty cycle for sheeting threshold declined from 90% to 68% as the DC offset was increased from −0.6 KV to +2.4 KV.

Figure 9:
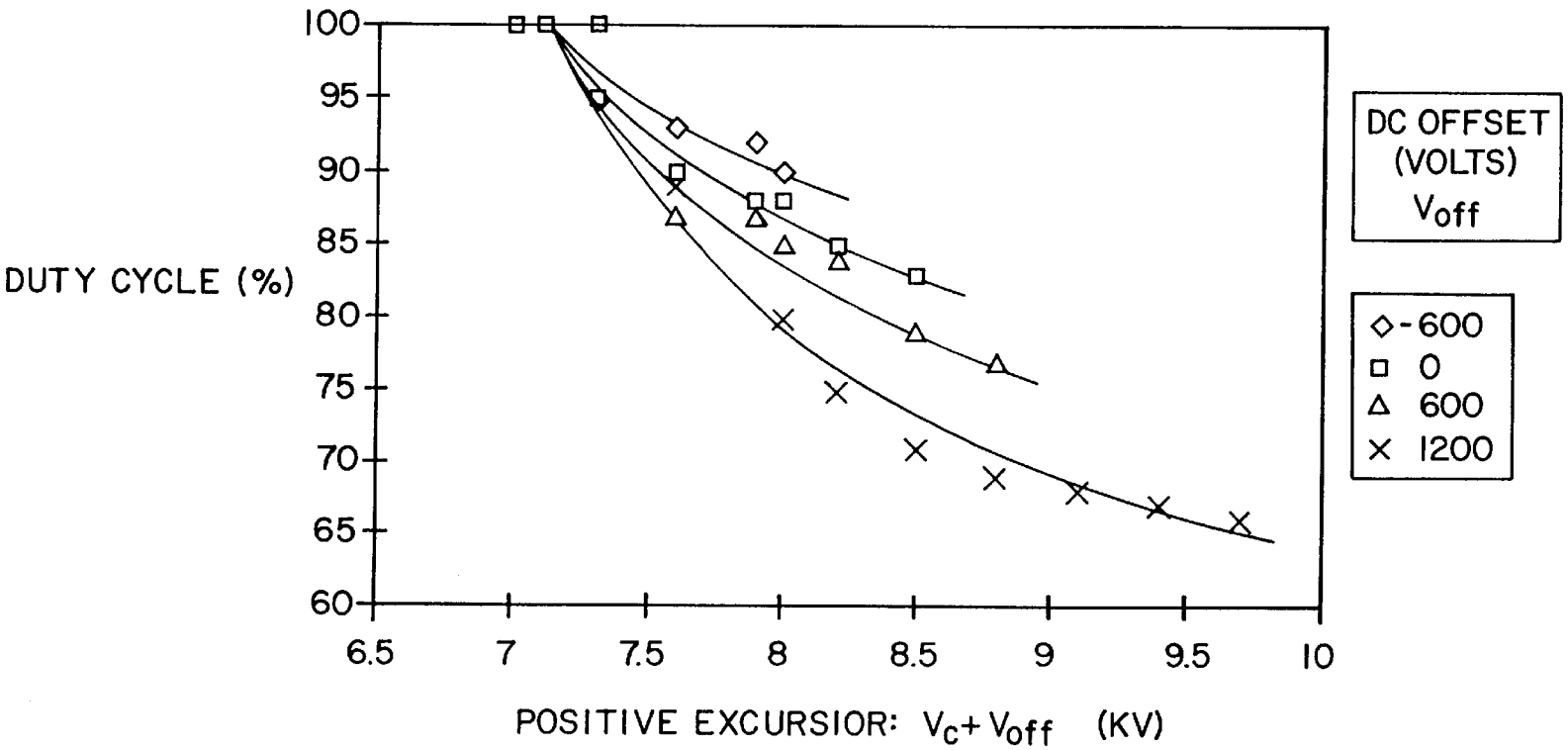

(c) When positive duty cycle for sheeting threshold was plotted as a function of (Vc+Voff) the result was a set of curves, see FIG. 9, one for each value of Voff, with all curves meeting for the condition 100% duty cycle, 7.1 KV.

The invention prolongs the useful life of gridded positive corona wire chargers by preventing or minimizing the formation of sheeting artifacts in positive charging of a photoconductor. This is accomplished by operating at high positive duty cycle, preferably between about 60% to about 85%, and more preferably between about 70% and about 80% duty cycle. Compared to prior art positive DC operation, useful operating life of a charger can be greatly extended. Example 3 indicates extension of life by as much as 67%.

In operation, the maximum positive peak voltage must be below a predetermined range of values characteristic of a given charger geometry. Alternatively, the time-averaged emission current from a corona wire must not exceed a predetermined range of values characteristic of a given charger geometry. The charger grid is energized at a convenient voltage, typically +600 volts, although other grid voltages may be employed in typical applications, for example in the range +300 to +1200 volts. Operational frequency is 600 Hz, although frequencies in the approximate range 60–6000 Hz may be employed. A charger not having a control grid may be employed in practicing the invention. In use of a charger without a grid, a positive charge may be provided to the shell and/or a positive DC offset to the corona wire and coronode.

Although the charger has been illustrated as a primary charger, the charger may be a detack charger, transfer charger or preclean charger. While the preferred embodiment illustrates use with generally trapezoidal shaped voltage waveforms, other shapes are also useful such as triangular as an example.

The invention has been described in detail with particular reference to preferred embodiments thereof, but it will be understood that variations and modifications can be effected within the spirit and scope of the invention as described hereinabove and as defined in the appended claims.

We claim:

1. A corona charger for depositing an electrostatic charge on a charge retentive surface, without the creation of sheeting defects, the charger comprising:

a coronode; and a power supply operating in cycles and providing in each of the cycles electrical power to the coronode to produce a net positive charging current with voltage to the coronode from the power supply operating in a portion of each cycle with a positive polarity to generate positive corona emissions, the power supply operating so that an AC component of the voltage provided by the power supply has a positive polarity in the range of about 60% to about 85% of each cycle.

2. The charger of claim 1 wherein frequency of the cycles is in the range of 60 Hz–6000 Hz.

3. The charger of claim 1 wherein the power supply provides a generally trapezoidal AC voltage signal to the coronode and wherein during operation in a negative polarity, the coronode is operative to generate negative corona emissions.

4. The charger of claim 3 and including a control grid and an electrical bias to the control grid to control a level of voltage established on the charge retentive surface.

5. The charger of claim 4 wherein the AC component of the power supply has a positive polarity in the range of about 70% to about 80% of the cycle.

6. The charger of claim 5 wherein the power supply operates in a constant current mode to provide the cycles at a frequency of 60 Hz–6000 Hz.

7. The charger of claim 1 wherein the AC component of the voltage provided by the power supply has a positive polarity in the range of about 70% to about 80% of the cycle.

8. The charger of claim 7 and including a control grid and an electrical bias to the control grid to control a level of voltage established on the charge retentive surface.

9. The charger of claim 8 wherein the power supply provides a generally trapezoidal AC signal to the coronode.

10. The charger of claim 1 wherein the coronode in operation in a negative polarity is operative to generate negative corona emissions.

11. The charger of claim 10 wherein the power supply operates within a range defined by $x \geqq 5.5$, $y < -10.95x + 185.5$, $50\% < y < 100\%$ wherein y is duty cycle in percent of positive polarity operation of the AC component of the voltage provided by the power supply and x is positive peak voltage in kilovolts to the coronode.

12. The charger of claim 11 wherein the power supply is operative to generate a DC equivalent current to the coronode that is less than about 28 μamps per cm of length of the coronode.

13. The charger of claim 11 wherein the power supply is operative to generate a DC equivalent current to the coronode that is less than about 19 μamps per cm of length of the coronode.

14. The charger of claim 10 wherein the power supply is operative to generate a DC equivalent current to the coronode that is less than about 28 μamps per cm of length of the coronode.

15. The charger of claim 14 and including a monitor for controlling DC equivalent current to the coronode.

16. The charger of claim 10 wherein the power supply is operative to generate a DC equivalent current to the coronode that is less than about 19 μamps per cm of length of the coronode.

17. The charger of claim 1 and including a monitor for sensing DC equivalent current to the coronode and a control controlling a parameter of operation of the charger.

18. A method for recording comprising:

providing a moving charge retentive surface;

depositing a uniform electrostatic charge on the charge retentive surface using the corona charger of claim 1;

imagewise modulating the electrostatic charge to form an electrostatic latent image on the charge retentive surface; and developing the electrostatic latent image to form a toned image.

19. The method of claim 18 wherein frequency of cycles is in the range of 60 Hz–6000 Hz and an electrical bias is provided to a control and forming a part of the charger to control a level of voltage established on the charge retentive surface and when operating in a negative polarity the coronode generates corona emissions.

20. The method of claim 18 and wherein during operation in a negative polarity the coronode generates negative corona emissions and DC equivalent current to the coronode is monitored and a parameter of operation of the charger is adjusted to maintain DC equivalent current to the coronode below a value causing sheeting.

21. A corona charger for depositing an electrostatic charge on a charge retentive surface, without the creation of sheeting defects, the charger comprising:

a coronode;

a power supply operating in cycles and providing in each of the cycles electrical power to the coronode to produce a net positive charging current with voltage to the coronode from the power supply operating in a portion of each cycle with a positive polarity to generate positive corona emissions and in a negative polarity to generate negative corona emissions, the power supply operating so that an AC component of the power supply has a positive polarity for more than 50% but less than 100% of each cycle, DC equivalent current to the coronode is less than about 28 μamps per cm length of the coronode and peak positive voltage to the coronode is less than 11 kilovolts.

22. The corona charger of claim 21 wherein the DC equivalent current to the coronode is less than about 19 μamps per cm length of the coronode.

23. A corona charger for depositing an electrostatic charge on a charge retentive surface, without the creation of sheeting defects, the charger comprising:

a coronode;

a power supply operating in cycles and providing in each of the cycles electrical power with voltage to the coronode from the power supply operating in each cycle with a positive polarity to generate positive corona emissions and a negative polarity to generate negative corona emissions, the power supply operating so that an AC component of the power supply has a positive polarity for more than 50% but less than 100% of each cycle; and a controller monitoring DC equivalent current to the coronode to maintain DC equivalent current below a value to prevent sheeting.

24. A corona charging apparatus for depositing an electrostatic charge on a charge retentive surface without the creation of sheeting defects, the apparatus comprising:

a coronode;

a power supply operating in cycles and providing in each of the cycles electrical power to the coronode with voltage to the coronode from the power supply operating in each cycle with a positive polarity to generate corona emissions and a negative polarity to generate corona emissions, the power supply operating within a range defined by $x \geqq 5.5$, $y < -10.95x + 185.5$, $50\% < y < 100\%$ wherein y is duty cycle in percent of positive polarity operation of the AC component of the power supply and x is positive peak voltage in kilovolts to the coronode.

* * * * *